United States Patent [19]

Burman

[11] 4,077,811

[45] Mar. 7, 1978

[54] PROCESS FOR "BLACK FABRICATION" OF MOLYBDENUM AND MOLYBDENUM ALLOY WROUGHT PRODUCTS

[75] Inventor: Russell W. Burman, Mentor, Ohio

[73] Assignee: AMAX, Inc., Greenwich, Conn.

[21] Appl. No.: 773,206

[22] Filed: Mar. 1, 1977

[51] Int. Cl.[2] ..... C22F 1/18

[52] U.S. Cl. ..... 148/11.5 F; 148/11.5 P

[58] Field of Search ..... 148/11.5 F, 11.5 P; 75/176

[56] References Cited

U.S. PATENT DOCUMENTS

| | | | |
|---|---|---|---|
| 2,666,721 | 1/1954 | Bechtold et al. | 148/11.5 F |
| 2,667,435 | 1/1954 | Marden et al. | 148/11.5 F |
| 2,678,272 | 5/1954 | Ham et al. | 148/11.5 F |

*Primary Examiner*—W. Stallard

*Attorney, Agent, or Firm*—Harness, Dickey & Pierce

[57] ABSTRACT

A process for the manufacture of molybdenum-base wrought products, commencing with a mass of metallic molybdenum or an alloy containing at least 50% molybdenum that is only moderately heated to within the temperature range of 500° F to about 1200° F; and while in an essentially "black-warm" condition (as contrasted to a red-hot condition) is deformed to wrought semi-finish products of the desired configuration, employing conventional working methods such as forging, rolling, or similar processes. The starting billet genesis can be either from vacuum-arc-cast or powder metallurgy ingot that is extruded at a temperature of about 1500° F to 2500° F, whereafter the extruded billet is annealed by heating for about one hour or longer to a temperature of from 2000° F up to about 3000° F to obtain a substantially fully annealed condition.

The "Black Fabricated" wrought product is generally stress relieved for an appropriate time at temperatures ranging from 1500° F to about 2500° F and normally surface conditioned to produce marketable mill products, such as sheet, plate, rods, bars, forged shapes and the like.

13 Claims, No Drawings

PROCESS FOR "BLACK FABRICATION" OF MOLYBDENUM AND MOLYBDENUM ALLOY WROUGHT PRODUCTS

BACKGROUND OF THE INVENTION

Molybdenum and various alloys, consisting predominantly of molybdenum, are in widespread commercial use in many everyday as well as special applications. The unique physical, chemical and mechanical properties of this refractory metal and its alloys, particularly at elevated temperatures, are responsible for the general field application to high temperature equipment and hot structural components.

The most common commercially available wrought products comprise essentially pure or lightly alloyed molybdenum, originally consolidated by either powder metallurgy or vacuum-arc-casting methods and two principal molybdenum alloys:

1. TZM molybdenum alloy, approximately 0.5% titanium, 0.08% zirconium, balance molybdenum (by weight)
2. molybdenum — 30% tungsten alloy, approximately 70% molybdenum, 30% tungsten (by weight).

Because molybdenum-base materials are subject to gross oxidation at temperatures above about 1200° F, with the profuse evolution of so-called molybdic oxide "smoke", that often renders both handling and fabrication rather hazardous, as well as causing significant material losses, the present process was invented and applied to molybdenum and various alloys.

It has heretofore been proposed to reduce or eliminate such "smoking" problems by performing the red hot molybdenum fabrication in a protective environment or by coating the billet to prevent oxidation attack thereof. Economic factors have precluded real success for either technique due to excessive process cost and/or product losses.

The process of the present invention provides a simple, ecologically clean, energy conservative, and commercially acceptable procedure for the fabrication of molybdenum-base wrought products, employing conventional working methods such as forging, round and flat rolling, or similar processes. The resultant products produced in accordance with the present invention exhibit at least equivalent mechanical properties, and in many instances exhibit unexpected superior properties to those produced in accordance with the prior art practices of red hot fabrication.

SUMMARY OF THE INVENTION

The benefits and advantages of the present invention are based upon the discovery that utilizing a billet of metallic molybdenum or an alloy containing at least 50% molybdenum fabrication by a deformation process can be efficiently accomplished in a moderate temperature range, without the visible detrimental molybdic oxide "smoke" formation. Oxidation protective, coatings, protective containers, or protective atmospheres, are not required at any time during either the warming operation or the actual deformation process.

The billet is initially warmed in the temperature range of 500° F to about 1200° F and is thereafter deformed conventionally, such as by forging or rolling in one or a plurality of successive deformation steps into wrought products, such as sheet, plate, rods, bars, forged shapes or the like. The term "Black Fabrication", as herein employed and as set forth in the subjoined claims, connotes the deformation of a molybdenum base material while heated to a moderate temperature of from about 500° F to about 1200° F in which condition it is of a black visible appearance without any evidence of smoking in contrast to conventional prior art practices employing higher temperatures in excess of about 1600° F, in which condition the material is of a red-hot appearance and is accompanied by a profuse evolution of molybdic oxide smoke. The resultant "Black Fabricated" wrought product is subjected to a terminal thermal stress relief for an appropriate time at temperatures ranging from 1500° to about 2500° F, and is normally surface conditioned to a finished product. The material at an intermediate stage of forging or rolling can be subjected to appropriate in-process annealing to facilitate further "Black Fabrication" to a final product.

The wrought product thus produced is characterized by at least equivalent mechanical properties, and in many instances, unexpectedly superior properties to the wrought product of the same composition produced in accordance with prior art practices at temperatures over 1600° F, at which the billet is red hot and severe oxidation "smoking" poses a problem.

The resultant wrought molybdenum produced in accordance with the practice of the present invention can be readily fabricated into suitable end products employing conventional machining and other metal finishing practices.

Additional benefits and advantages of the present invention will become apparent upon a reading of the description of the preferred embodiments taken in conjunction with the specific examples provided.

DESCRIPTION OF THE PREFERRED EMBODIMENTS

The process of the present invention is specifically applicable for the fabrication of wrought molybdenum products, as well as alloys containing at least 50% molybdenum in combination with other alloying constituents. A common commercial source of molybdenum-base billets is from consolidation by vacuum-arc-casting procedures, in which molybdenum powder is compacted, sintered and arc melted within a consumable electrode vacuum-arc-melt furnace to full density, in accordance with the arrangement as typically described in U.S. Pat. Nos. 2,651,952 and 2,656,743, which are assigned to the same assignee as the present invention.

Another consolidation method involves the commercial production by powder metallurgy techniques, in which molybdenum powder is compacted and sintered into a coherent mass with density usually greater than 90% of theoretical, but not full density.

The molybdenum billet for "Black Fabrication" is usually produced by hot axial extrusion at temperatures ranging from about 1500° up to about 2500° F at an extrusion ratio of at least about 2:1 which serves to structurally refine the coarse cast grain structure of vacuum-arc-cast molybdenum and to densify as well as homogenize the structure of powder metallurgy materials. The strain hardening at red heat by extrusion is followed by a full thermal anneal by heating for about one hour or longer to a temperature of from about 2000° up to about 3000° F that renders the material amenable to "Black Fabrication" procedures for the manufacture of wrought products by forging, round or flat rolling, or similar processes. The term "forging" as herein used encompasses hammer forging, press forging, closed and open die forging, rotary forging, and the like. Normally, the fully annealed billet is further conditioned by chemical or mechanical processes, e.g., pickling, machining, grinding, sand blasting, etc., to remove surface imperfections and/or impurities.

While temperatures as low as 500° F have been successful for "Black Fabrication" of molybdenum in accordance with the present invention, temperatures close to the 1200° F maximum are preferred for assured ductile behavior during deformation and relative ease of the deformation process. Temperatures below about 500° F are unsatisfactory because of brittle behavior and possible failure of the material during the deformation process, as well as the inordinately higher deformation forces required and tool wear at such lower temperatures. Fabrication temperatures above about 1200° F are undesirable in that they result in oxidation "smoking", material losses, environmental contamination and handling difficulties during actual manufacturing operations.

Experience with "Black Fabrication" dictates that temperature control in the upper portion of permissible range as hereinabove specified, and particularly about 1000° F to about 1200° F, while completely free of "smoking", results in only modestly greater deformation forces than those required to effect similar hot work levels of such billets at red-heat temperatures above 1600° F in accordance with prior art practices.

In those instances in which a plurality of successive "Black Fabrication" passes are required to produce the finish size and configuration, these may be applied with or without benefit of in-process thermal anneals to arrive at appropriate levels of residual cold work in the wrought product.

In addition to the elimination of problems associated with prior art red-hot temperature fabrication processes, "Black Fabrication" has been found in many instances to afford unexpected improvements in the hardness, strength, ductility, and apparent toughness of the wrought product.

In order to further illustrate the process of the present invention, the following examples are provided. It is understood, however, that the specific examples hereinafter set forth are supplied for illustrative purposes and are not intended to be limiting of the scope of the present invention as herein described and as set forth in the subjoined claims.

EXAMPLE 1

A vacuum-arc-cast molybdenum extruded billet is first "Black Fabricated" by forging to a sheet bar, then "Black Fabricated" by flat rolling to 0.020 inch and 0.010 inch thick sheet product.

Commencing with a fully annealed round billet 4¾ inches diameter by 15 inches long, weighing about 100 pounds, the billet is briefly warmed to a black-heat temperature of about 1200° F in air, without any evidence of smoking. The warmed billet is then flat forged to an intermediate rectangular sheet bar of a nominal thickness of 2 inches and a width of about 8 inches and a length of about 18 inches, whereafter it is permitted to cool to room temperature. The resultant sheet bar is subsequently warmed to a black-heat temperature of about 1200° F in air, without any evidence of smoking, and is subjected to break down rolling using multi-pass procedures to approximately ½ inch thickness, with only about 20% additional rolling force required in comparison to hot rolling forces required by prior art practices.

The resultant ½ inch plate is again warmed to a black-heat temperature of about 1000° F in air, without any evidence of smoking, and is subjected to finish rolling using multi-pass procedures to 0.020 inch thick by random width by random length (× RW × RL) and 0.010 inch thick × RW × RL sheet products. The resultant wrought sheet mill product is subjected to a stress relief anneal by placing it in a furnace having a protective atmosphere in which it is heated to a temperature of about 1600° F for 1 hour to effect the relief of the residual stresses therein. The resultant sheet products are characterized as having tensile strength above 115,000 psi, yield strength above 95,000 psi and ductility in excess of 5% elongation.

EXAMPLE 2

A vacuum-arc-cast TZM molybdenum alloy (approximately 0.5% titanium, 0.08% zirconium, balance molybdenum) extruded billet is "Black Fabricated" by forging to a disc for application as a hot work tool insert.

Commencing with a fully annealed round billet 4¾ inches diameter by 6-9/16 inches long, weighing about 45 pounds, the billet is warmed to a black-heat temperature of about 1200° F in air, without any evidence of smoking. The warmed billet is free upset forged over 70% reduction to a nominal 9½ inches diameter by 1¾ inch thick disc, employing a 6000 pound hammer. Only about 30% more hammer blows are required than for red-hot forging by prior art practices. An intervening rewarming of the workpiece for black fabrication is ordinarily unnecessary. The resultant forged disc is characterized by a hardness of 253;14 257 Brinell Hardness Number (NHN) in comparison to 239–248 BHN for the identical disc hot forged at about 2300° F in accordance with prior art practices.

EXAMPLE 3

In order to evaluate the relative round rolling requirements and resultant mechanical properties of bars produced by black fabrication in comparison to bars produced by red-hot prior art fabrication practices, three different bar stock materials in a fully annealed condition were round rolled to a nominal ⅝ inch diameter. Vacuum-arc-cast molybdenum bar stock, powder metallurgy molybdenum bar stock, and TZM molybdenum alloy (approximately 0.5% titanium, 0.08% zirconium, balance molybdenum) bar stock were selected as the test materials.

Commencing with full annealed 1 inch diameter by 15 inches – 18 inches long bars briefly warmed to a black-heat temperature of about 1150° F in air, without any evidence of smoking, the heated bars are round rolled from one inch diameter to ⅝ inch diameter in six alternating oval-round mill passes. The average increase in roll separation force for "Black Fabrication" is about 17% for the vacuum-arc-cast molybdenum, 30% for the powder metallurgy molybdenum, and 18% for the TZM molybdenum alloy. The resultant rolled bars are characterized by about 5% greater strength than for the identical hot rolled bars produced by prior art practices, and improved ductility by as much as 9% better than prior art practices.

While it will be apparent that the invention herein described is well calculated to achieve the benefits and advantages set forth above, it will be appreciated that the invention is susceptible to modification, variation and change without departing from the spirit thereof.

What is claimed is:

1. A process for the fabrication of molybdenum-base wrought products which comprise the steps of providing a molybdenum material containing at least 50% molybdenum in a substantially fully annealed condition, warming the said material to a temperature in the range of about 500° to about 1200° F, deforming the warmed said material into a wrought product.

2. The process as defined in claim 1, in which the step of deforming said molybdenum material is achieved by forging.

3. The process as defined in claim 1, in which the step of deforming said molybdenum material is achieved by rolling.

4. The process as defined in claim 1, in which said molybdenum material is comprised of a vacuum-arc-cast ingot that is extruded at a temperature of about 1500° to 2500° F and is thereafter subjected to a recrystallization annealment at a temperature of about 2000° to about 3000° F.

5. The process as defined in claim 1, in which said molybdenum material is comprised of a powder metallurgy molybdenum ingot that is extruded at a temperature of about 1500° to 2500° F and is thereafter subjected to a recrystallization annealment at a temperature of about 2000° to about 3000° F.

6. The process as defined in claim 1, in which the step of deforming said molybdenum material is performed in a plurality of successive deforming increments.

7. The process as defined in claim 1, in which the step of deforming said molybdenum material to an intermediate shape is followed by subsequent deforming of said intermediate shape to a final wrought product.

8. The process as defined in claim 1, in which the step of heating said molybdenum material prior to the deformation step is controlled to within a temperature of about 1000° to about 1200° F.

9. The process as defined in claim 1, including the further step of heating said wrought product to a temperature of about 1500° to About 2500° F for a period of time sufficient to effect stress relief anneal thereof.

10. The process as defined in claim 9, in which the step of heating said wrought product to effect stress relief anneal thereof is performed for a period of about ¼ hour up to about 2 hours.

11. The process as defined in claim 1, in which said molybdenum material comprises a TZM alloy containing about 0.5% titanium, about 0.08% zirconium and the balance essentially molybdenum.

12. The process as defined in claim 1, in which said molybdenum material comprises an alloy containing about 30% tungsten and the balance essentially molybdenum.

13. The process as defined in claim 1, in which said molybdenum material comprises a substantially pure molybdenum.

* * * * *